US007331562B2

(12) United States Patent
Springett

(10) Patent No.: US 7,331,562 B2
(45) Date of Patent: Feb. 19, 2008

(54) BLOWOUT PREVENTER WITH BREECH ASSEMBLY

(75) Inventor: Frank Benjamin Springett, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 11/268,680

(22) Filed: Nov. 7, 2005

(65) Prior Publication Data

US 2007/0102655 A1 May 10, 2007

(51) Int. Cl.
*E21B 33/06* (2006.01)

(52) U.S. Cl. ..... 251/1.3; 137/315.02; 92/128; 166/85.4

(58) Field of Classification Search ..... 251/1.1, 251/1.3; 137/315.02; 92/128; 166/85.4
See application file for complete search history.

(56) References Cited

U.S. PATENT DOCUMENTS

| | | | | |
|---|---|---|---|---|
| 1,910,663 | A * | 5/1933 | Abercrombie et al. | 251/26 |
| 2,146,470 | A * | 2/1939 | Grantham et al. | 251/1.3 |
| 2,592,197 | A | 4/1952 | Schweitzer | |
| 3,040,611 | A | 5/1962 | Tournaire | |
| 3,472,270 | A | 10/1969 | Masheder | |
| 3,554,278 | A | 12/1970 | Reistle, III et al. | 166/85 |
| 3,554,480 | A | 1/1971 | Rowe | 251/1 |
| 3,647,174 | A | 3/1972 | Lerouax | 251/1 |
| 3,670,761 | A | 6/1972 | Lerouax | 137/315 |
| 3,716,068 | A | 2/1973 | Addison | 137/67 |
| 3,766,979 | A | 10/1973 | Petrick | 166/55 |
| 3,863,667 | A | 2/1975 | Ward | 137/318 |
| 3,918,478 | A | 11/1975 | Lerouax | 137/315 |
| 3,955,622 | A | 5/1976 | Jones | 155/0.5 |
| 4,043,389 | A | 8/1977 | Lobb | 166/55 |
| 4,132,265 | A | 1/1979 | Williams, Jr. | 166/55 |
| 4,215,749 | A | 8/1980 | Dare et al. | 166/361 |
| 4,253,638 | A | 3/1981 | Troxell, Jr. | 251/1 A |
| 4,372,527 | A * | 2/1983 | Rosenhauch et al. | 251/1.3 |
| 4,437,643 | A | 3/1984 | Brakhage, Jr. et al. | 251/1 A |
| 4,492,359 | A * | 1/1985 | Baugh | 251/1.3 |
| 4,504,037 | A | 3/1985 | Beam et al. | 251/1 |
| 4,537,250 | A | 8/1985 | Troxell, Jr. | 166/55 |
| 4,550,895 | A | 11/1985 | Shaffer | 251/1.3 |
| 4,558,842 | A | 12/1985 | Peil et al. | 251/1.3 |
| 4,699,350 | A | 10/1987 | Herve | 251/1.3 |
| 4,969,390 | A | 11/1990 | Williams, III | 92/28 |
| 5,013,005 | A | 5/1991 | Nance | 251/1.3 |
| 5,360,061 | A | 11/1994 | Womble | 166/55 |
| 5,400,857 | A | 3/1995 | Whitby et al. | 166/297 |
| 5,421,545 | A * | 6/1995 | Schexnayder | 251/30.02 |
| 5,505,426 | A | 4/1996 | Whitby et al. | 251/1.3 |
| 5,515,916 | A | 5/1996 | Haley | 166/55 |
| 5,575,451 | A | 11/1996 | Colvin et al. | 251/1.3 |
| 5,897,094 | A | 4/1999 | Brugman et al. | 251/1.3 |

(Continued)

*Primary Examiner*—John K. Fristoe, Jr.
(74) *Attorney, Agent, or Firm*—Guy McClung

(57) ABSTRACT

A blowout preventer which, in certain aspects, has a main body with a main top, a main bottom, and a main bore therethrough from the main top to the main bottom, at least one breech assembly secured to the main body, ram apparatus movable within the breech assembly and the main body, the breech assembly having a chamber for enclosing part of the ram apparatus, the chamber having a side opening, a sleeve around the breech, and the sleeve movable with respect to the breech assembly to uncover the side opening to permit access to ram apparatus within the chamber of the breech.

20 Claims, 9 Drawing Sheets

U.S. PATENT DOCUMENTS 6,173,770 B1 1/2001 Morrill ..... 166/85.4
6,510,897 B2 1/2003 Hemphill ..... 166/373
6,554,247 B2 * 4/2003 Berckenhoff et al. ..... 251/1.3
6,969,042 B2 11/2005 Gaydos ..... 251/1.3
7,044,430 B2 5/2006 Brugman et al. ..... 251/1.1
7,051,990 B2 5/2006 Springett et al. ..... 251/1.1

* cited by examiner

FIG. 4A
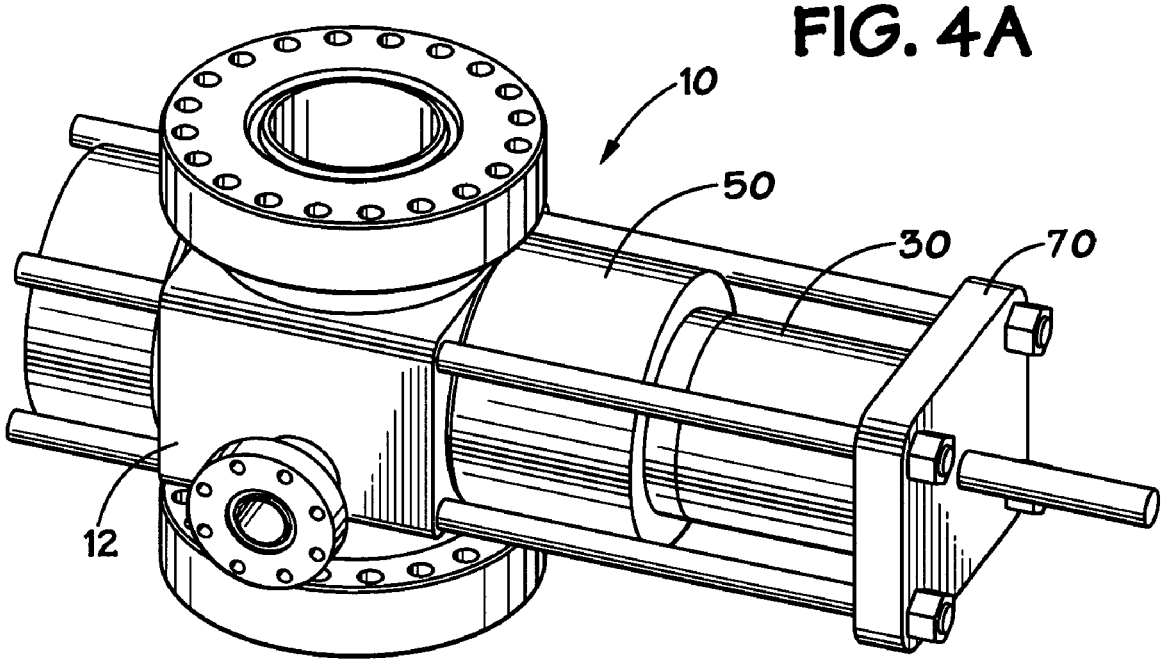
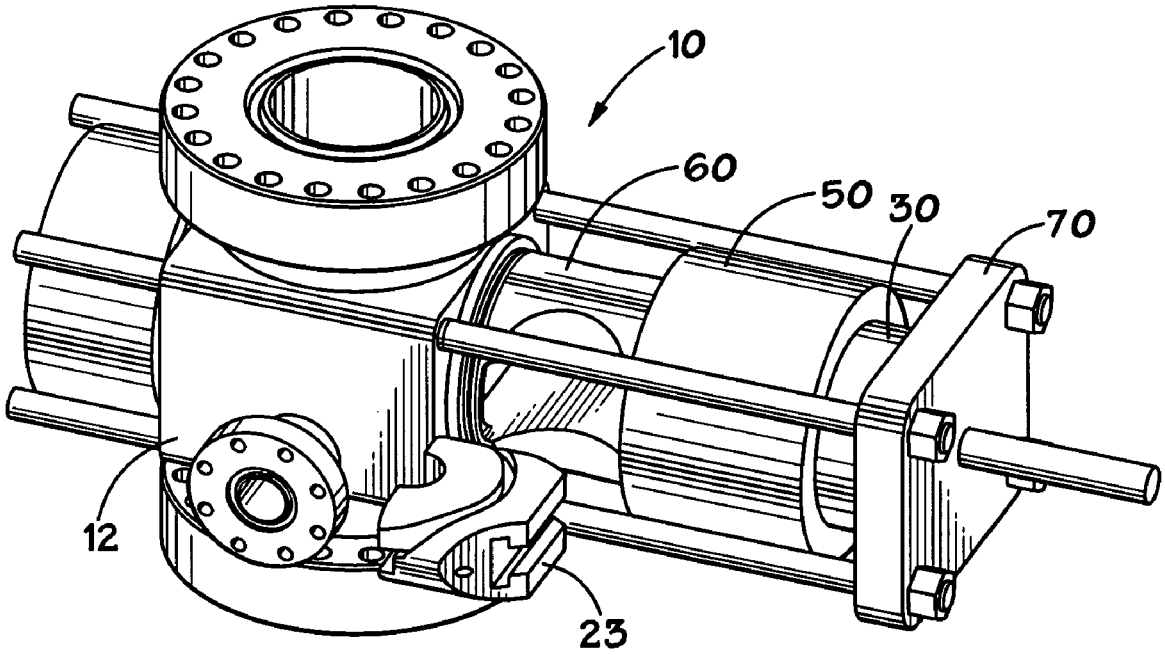
FIG. 4B

BLOWOUT PREVENTER WITH BREECH ASSEMBLY

BACKGROUND OF THE INVENTION

1. Field of the Invention

This present invention is directed to blowout preventers; to breech housings for ram blocks for blowout preventers; in certain particular aspects, to movable breech housings which permit easy access to ram blocks therein; and methods of their use.

2. Description of Related Art

The prior art discloses a wide variety of blowout preventers and blowout preventer doors and bonnets.

Typical blowout preventers have selectively actuatable rams with actuators in oppositely disposed portions or bonnets. Doors over these portions or bonnets themselves are movably secured to the body, e.g. with movable bars or with hinges so that a door or bonnet is movable for access and maintenance. The prior art discloses a variety of rams including, but not limited to, pipe rams (to contact, engage, and encompass pipe and/or tools to seal a wellbore); blind rams; multi-rams; and shear rams (to contact and physically shear a pipe or tool in a wellbore). Rams are typically positioned opposite each other on either side of a main body and seal against within the main body upon actuation.

Typical rams include a ram block with various parts, e.g. seals and/or cutting edges or blades. Such seals can be subject to high pressures and to chemical reaction with drilling fluids which can damage the seals. Often rams are inspected or changed out. Prior art systems include a variety of movable doors and bonnets for accessing rams and seals. Blowout preventers are disclosed in many U.S. Patents, including, but not limited to, U.S. Pat. Nos. 3,946,806; 4,043,389; 4,313,496; 4,132,267, 4,558,842; 4,969,390; 4,492,359; 4,504,037; 2,752,119; 3,272,222; 3,744,749; 4,253,638; 4,523,639; 5,025,708; 5,056,418; 5,400,857; 5,575,452; 5,655,745; and 5,918,851.

In many prior art blowout preventers a main body of the blowout preventer is subjected to a variety of stresses and loads, including loads applied to the main body either by or through bonnets or doors and actuators therein. In certain prior art systems these loads have been dealt with by providing relatively massive bodies. One solution to this loading problem has been to make a blowout preventer's main body sufficiently massive that it can adequately deal with any load imposed thereon.

There has long been a need, recognized by the present inventor, for a blowout preventer with easy access to a ram block and for easily moving such a ram block to a position at which it can be inspected and/or replaced.

There has long been a need, recognized by the present inventor for a relatively compact, light weight, relatively inexpensive blowout preventer. There has long been a need for a blowout preventer which effectively and efficiently deals with loads imposed on the blowout preventer and which can be made with relative ease.

SUMMARY OF THE PRESENT INVENTION

In one aspect, the present invention discloses a blowout preventer with a selectively accessible ram-apparatus-containing breech and a sleeve housing the breech, the sleeve selectively movable to permit access to a ram block within the breech. In certain aspects there is at least one pair of such breeches each with a corresponding ram and in other aspects there are two, three, four, five or more pairs of such breeches in one integral main body so that multiple blowout preventers are provided in one body.

In certain aspects a blowout preventer according to the present invention has dual opposed ram apparatus housings or bonnets on either side of a blowout preventer's main body. The housings or bonnets are mounted on rods or similar members which extend through or adjacent the main body so that each rod supports each of the dual opposed housings or bonnets, thus isolating the main body from loads imposed on the housings or bonnets and isolating the main body from loads imposed by the housings, actuators, and or bonnets. The rods, in certain aspects, also support doors or other covers which permit access to the main body and/or to the interior of the housings or bonnets; and this support of the doors by the rods isolates the main body from loads imposed on or by the doors. In certain aspects the present invention provides a bolted tie rod system which reduces loads on a main body of a blowout preventer; and in other aspects a non-bolted tie rod system is used with long tie rods extending through the body.

In certain aspects, a blowout preventer according to the present invention has major components made of composite material rather than metal, e.g. but not limited to carbon fiber composite materials and/or wound fiber composites. For example a blowout preventer according to the present invention may have a main body, breech, a sleeve movable around the breech, an operator assembly housing made of composite material, and/or rods.

The present invention discloses, in certain aspects, a blowout preventer with: a main body with a main top, a main bottom, and a main bore therethrough from the main top to the main bottom; at least one breech assembly secured to the main body; ram apparatus movable within the breech assembly and the main body; the breech assembly having a chamber for selectively enclosing the ram apparatus, the chamber having a side opening; a sleeve around the breech; and the sleeve movable with respect to the breech assembly to uncover the side opening to permit access to ram apparatus within the chamber of the breech.

The present invention discloses, in certain aspects, a breech assembly for a blowout preventer, the blowout preventer having a main body for selectively containing ram apparatus, and a ram apparatus opening into which ram apparatus is passable to enter the main body, the breech assembly including: a breech body securable to the main body; a chamber within the breech body, ram apparatus selectively positionable within the chamber; a chamber opening through which the ram apparatus is passable to enter the ram apparatus opening of the main body of the blowout preventer; and a side opening through a side of the breech body, the ram apparatus accessible within the chamber through the side opening; and/or the ram apparatus including a ram block and the side opening is sized for removal of the ram block from the chamber.

It is, therefore, an object of at least certain preferred embodiments of the present invention to provide new, useful, unique, efficient, nonobvious blowout preventers and methods of their use.

It is, therefore, an object of at least certain preferred embodiments of the present invention to provide new, useful, unique, efficient, nonobvious ram block access apparatus for blowout preventers and blowout preventers with such access apparatus;

Such ram block holding apparatus which includes a selectively accessible breech (or breeches) in which a ram block can be accessed and a sleeve around the breech which is movable to permit access to the ram block;

It is, therefore, an object of at least certain preferred embodiments of the present invention to provide new, useful, unique, efficient, nonobvious blowout preventers with at least one ram containing breech and/or with major parts thereof made of composite materials.

It is, therefore, an object of at least certain preferred embodiments of the present invention to provide new, useful, unique, efficient, nonobvious blowout preventers with structure for reducing loading on a main body.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 4A shows steps in a method of operation according to the present invention of a blowout preventer according to the present invention as in FIG. 1A.

FIG. 4B shows steps in a method of operation according to the present invention of a blowout preventer according to the present invention as in FIG. 1A.

DESCRIPTION OF EMBODIMENTS PREFERRED AT THE TIME OF FILING FOR THIS PATENT

Figure 1A:
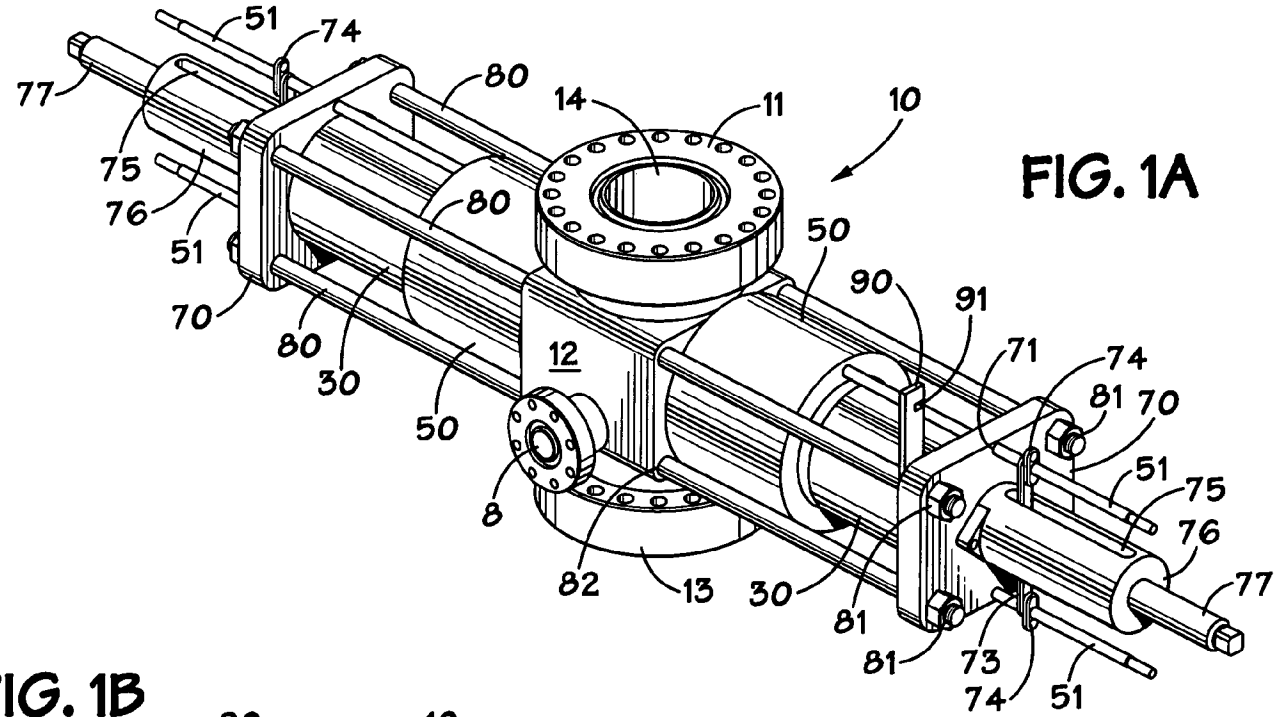
FIG. 1A is a perspective view of a blowout preventer according to the present invention.
Figure 1B:
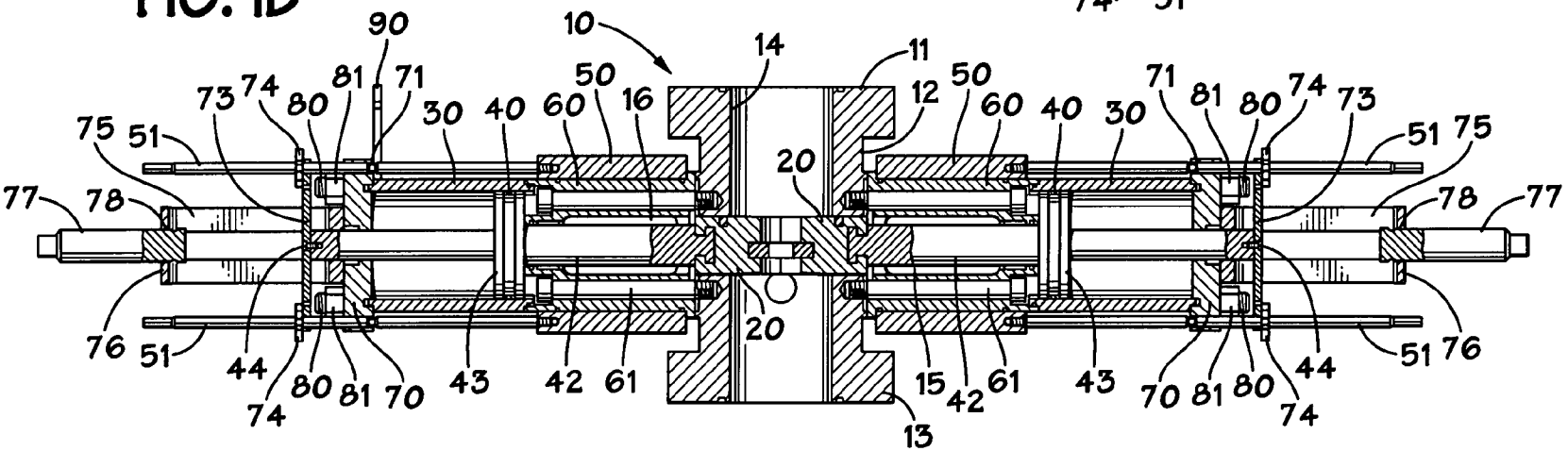
FIG. 1B is a cross-section view of the blowout preventer of FIG. 1A.

As shown in FIGS. 1A and 1B, a blowout preventer 10 according to the present invention has a main body 12 with a top flange 11, a bottom flange 13, a side outlet 8, a bore 14 therethrough from top to bottom, and openings 15, 16 through which rams 20 are movable.

Actuator housings 30 surround actuators 40, each with a shaft 42 connected to a ram 20 for selectively moving the rams 20 hydraulic fluid under pressure into the main body 12 and out from the main body 12.

Movable sleeves 50 surrounds breeches 60 on each side of the blowout preventer. The breeches 60 are secured to the blowout preventer with bolts 61. Rods 51 are secured at one end to the sleeves 50 and pass movably through openings 71 in plates 70. Bars 73 are connected to the shaft 42 with bolts 44 and, at each of its ends, releasably connectable to the rods 51 with releasable connectors 74. The bars 73 are movable with the shafts 42 and within openings 75 in cylinders 76. Manual locks 77 are threaded and manually lock the rams in place. The locks 77 extend through openings 78 into the cylinders 76.

The plates 70 are connected to each other with rods 80 and nuts 81 (four rods 80, three shown in FIG. 1A). The rods 80 extend through holes 82 through the main body 12. The plates 70 support the actuator housings 30 and their contents and isolate the body from loads imposed by wellbore pressure acting on the breeches; i.e., the body is not subjected to this wellbore pressure and, therefore, in certain aspects the body need not be as massive as in certain prior blowout preventers.

A pivotable latch 90 is pivotably connected to a rod 80 and is pivotable so that a recess 91 latches onto a rod 51 to prevent movement of the sleeves 50.

Figure 2A:
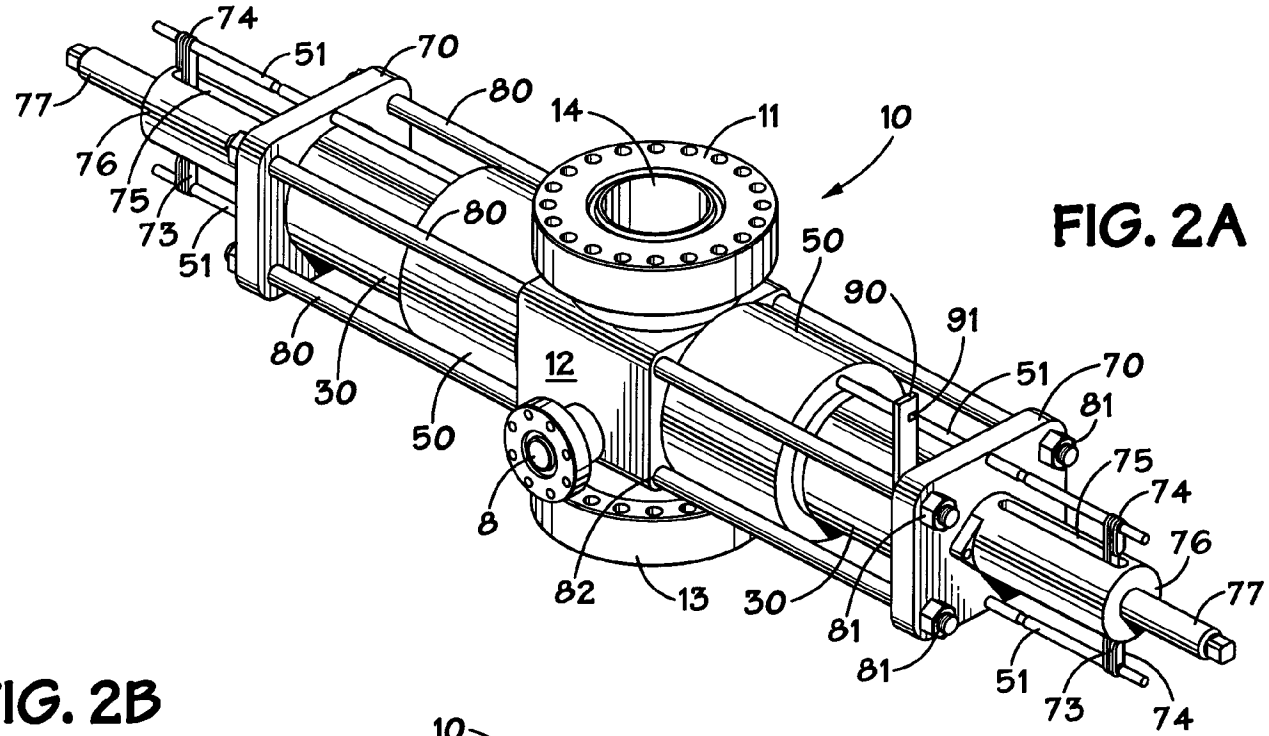
FIG. 2A is a perspective view of the blowout preventer of FIG. 1A.
Figure 2B:
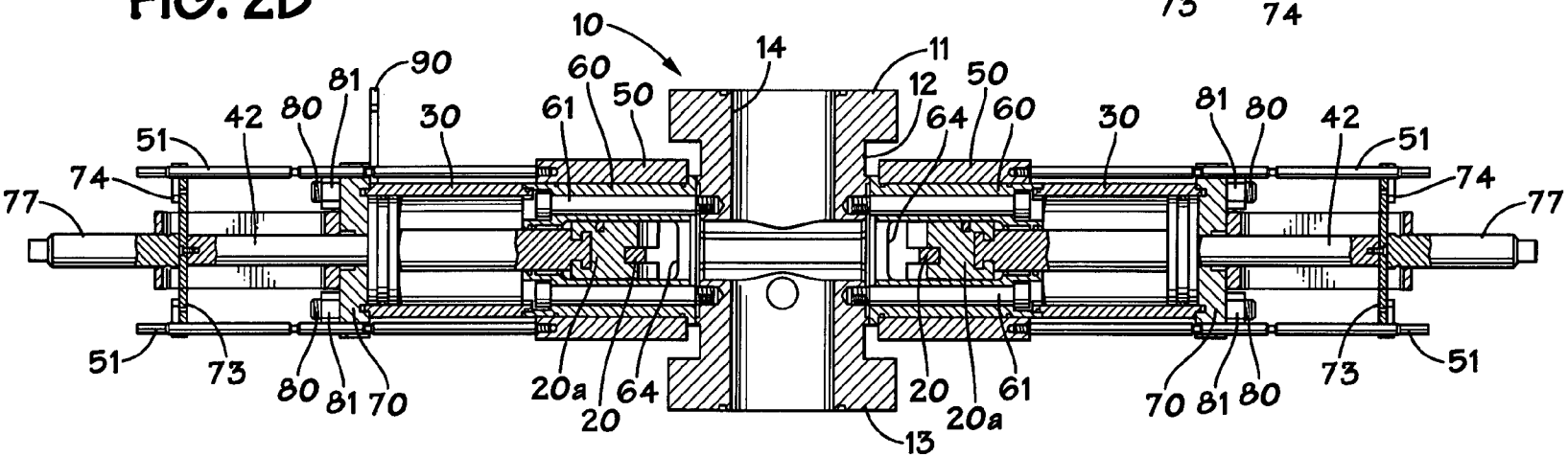
FIG. 2B is a cross-section view of the blowout preventer of FIG. 2A.

As shown in FIGS. 2A and 2B, the actuators 40 have moved the rams 20 from the main body 12 and the bars 73 have moved outwardly with the shafts 42. Upon release of the connectors 74, the sleeves 50 are free to move.

Figure 3A:
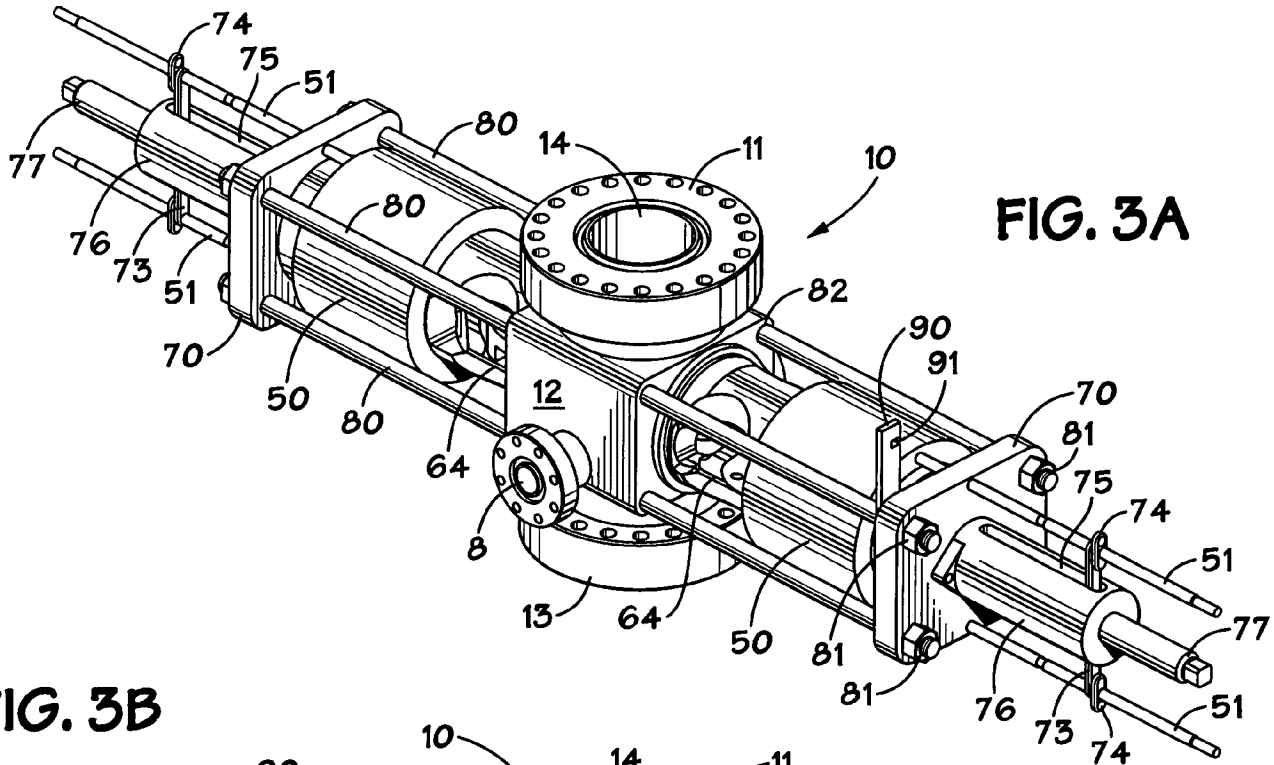
FIG. 3A is a perspective view of the blowout preventer of FIG. 1A.
Figure 3B:
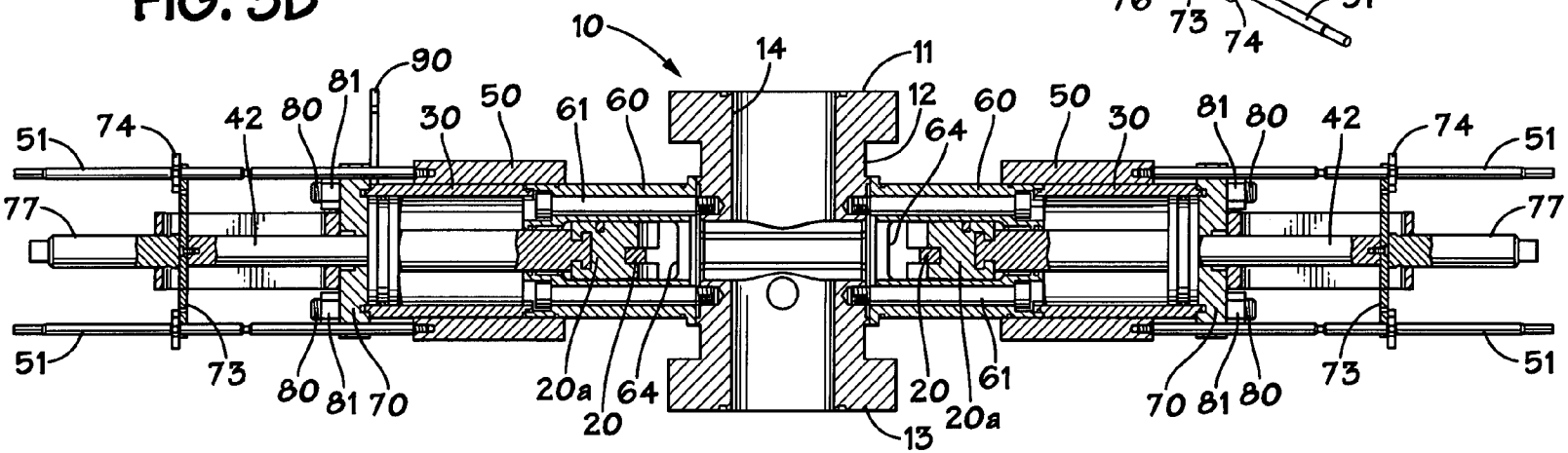
FIG. 3B is a cross-section view of the blowout preventer of FIG. 2A.

As shown in FIGS. 3A and 3B, the sleeves 50 and the rods 51 connected to them have moved outwardly, exposing the rams 20 in chambers 62 of the breeches 60. The rams 20 can now be accessed for inspection and repair; or, the rams 20, including associated ram blocks 20*a*, can be removed through openings 64 in the breeches 60.

Figure 4C:
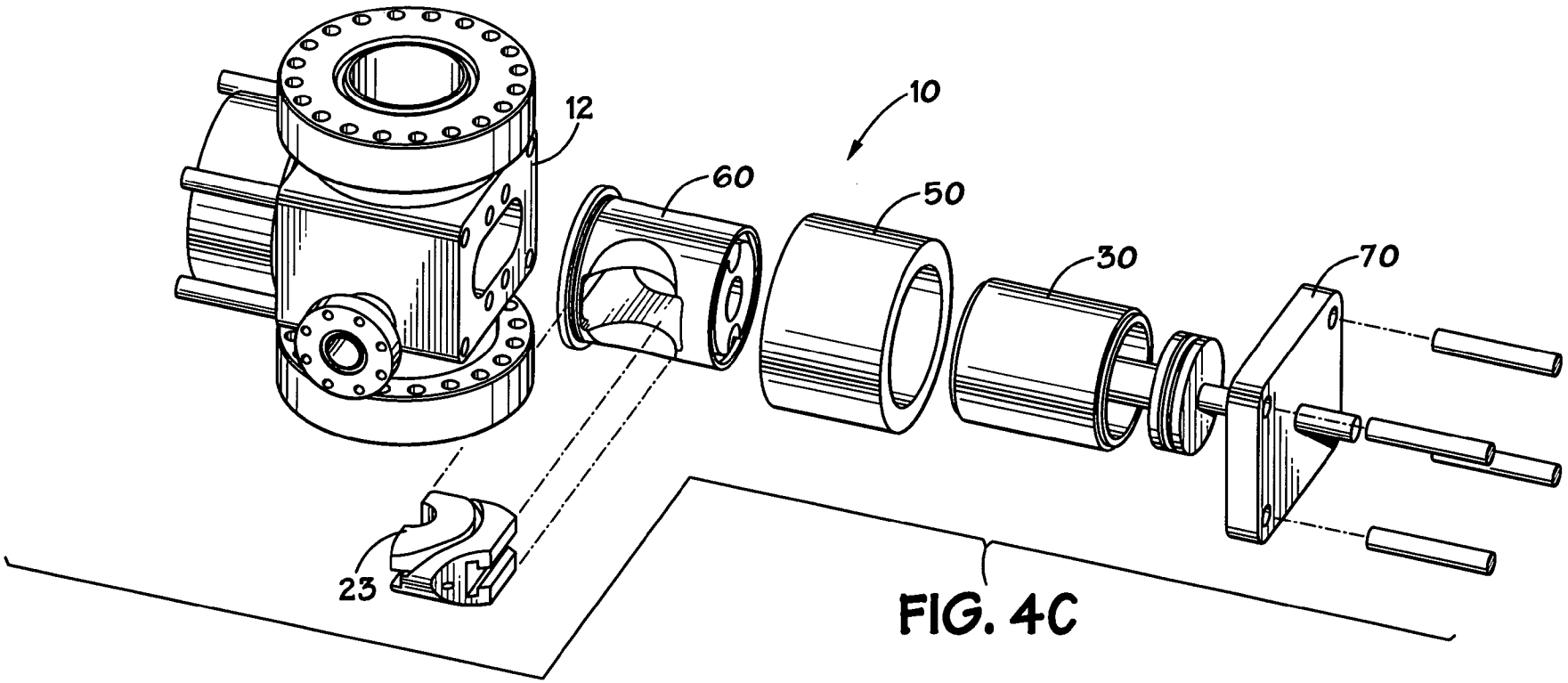
FIG. 4C shows steps in a method of operation according to the present invention of a blowout preventer according to the present invention as in FIG. 1A.

FIGS. 4A-4C illustrate removal of a ram block and other parts from a blowout preventer 10. As shown in FIG. 4A a sleeve 50 has not yet been moved. As shown in FIG. 4B, the sleeve 50 has moved to expose a ram block 23 in the breech 60. Removal of the ram block 23 has been initiated through the opening.

FIG. 4C shows the ram block 23 outside of the breech 60 and separated from the blowout preventer 10. Also shown is separation of the breech 60, sleeve 50, and actuator housing 30, and plate 70 from the main body 12.

It is within the scope of the present invention to make major parts of the blowout preventers according to the present invention from metal, as has been done in the past; or, according to the present invention, to make them and their major parts from composites. In certain aspects breeches, sleeves, actuator housings, plates (e.g. plates 70) shafts (e.g. shafts 42) and rods 80 are made of composites.

In certain aspects, the sleeve (e.g. the sleeve 50) is pressure balanced in the direction of its axis and thus requires no external force or lock to remain closed when the blowout preventer is pressurized. Diameters at opposed ends of the sleeve are equal, areas at these points are equal, so there is no net force due to wellbore pressure. Wellbore pressure on the sleeve does not move the sleeve. Alternatively, in other aspects the sleeve is arranged so that the wellbore pressure holds the sleeve in closed position, with one end of the sleeve having a larger diameter than the other. The breech structure transfers axial end loads into the blowout preventer using the combination of the internal and external threaded rods or bolts (as shown, e.g. in FIGS. 1B and 2A).

Figure 5A:
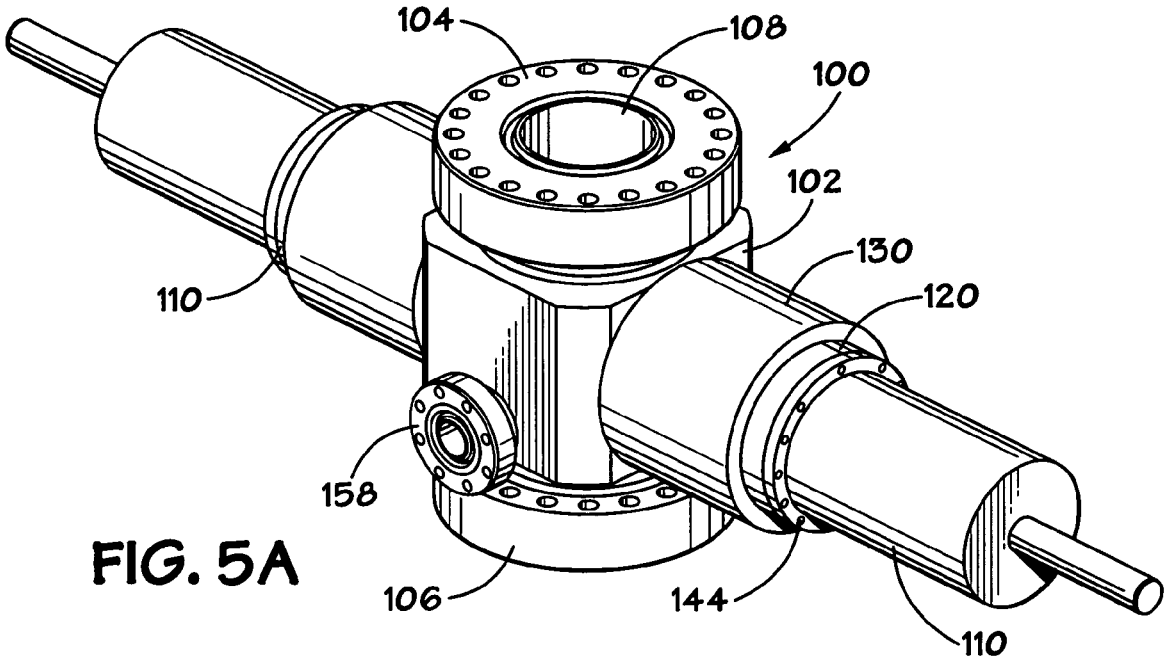
FIG. 5A is a perspective view of a blowout preventer according to the present invention.
Figure 5B:
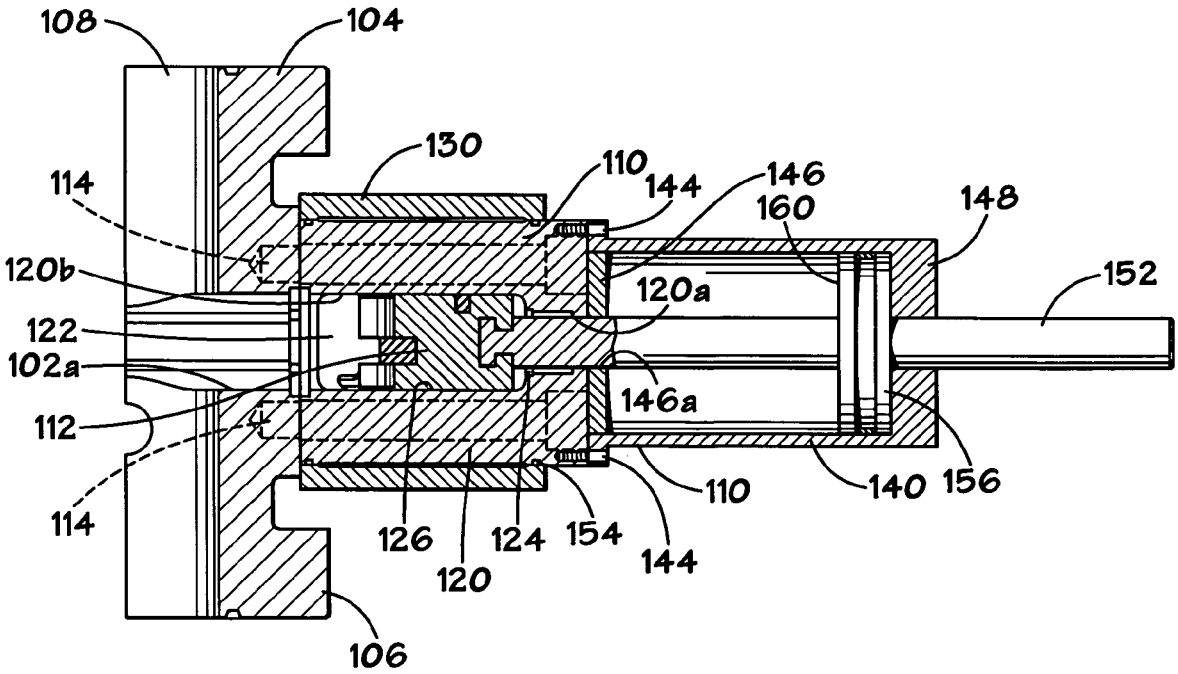
FIG. 5B is a cross-section view of the blowout preventer of FIG. 5A.
Figure 6A:
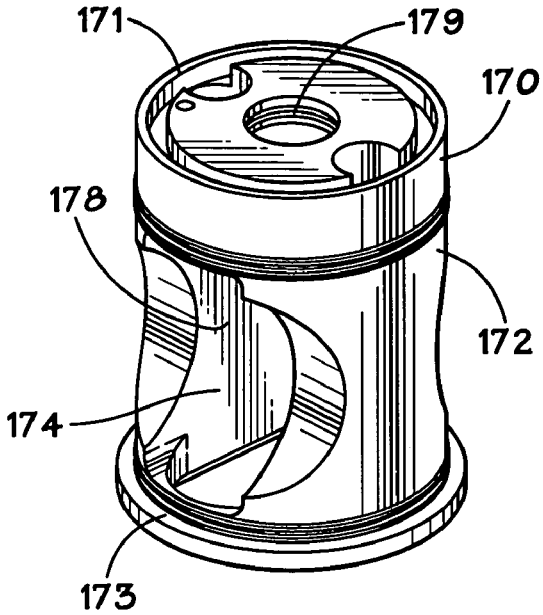
FIG. 6A is a perspective view of a breech according to the present invention for a blowout preventer.
Figure 6B:
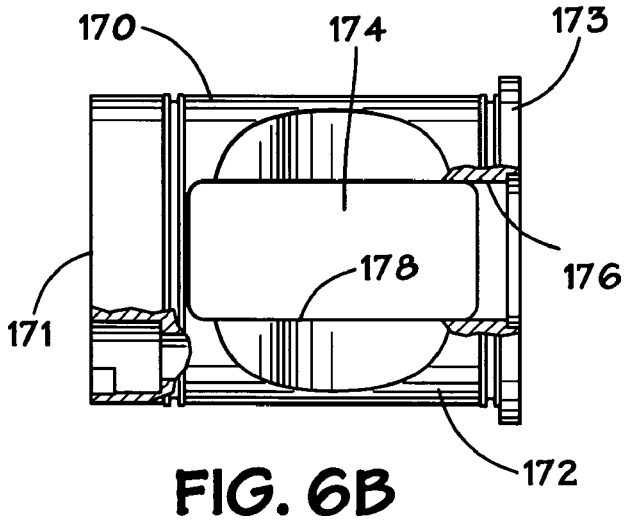
FIG. 6B is a cross-section view of the breech of FIG. 6A.
Figure 6C:
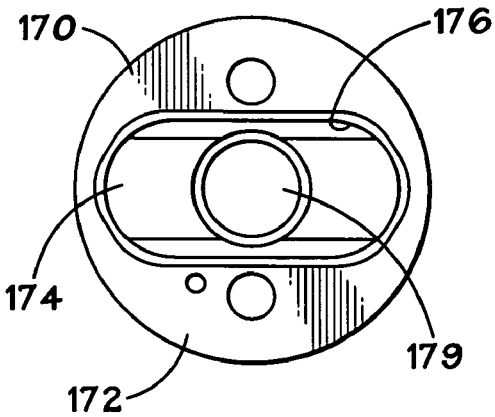
FIG. 6C is a cross-section view of the breech of FIG. 6A.
Figure 6D:
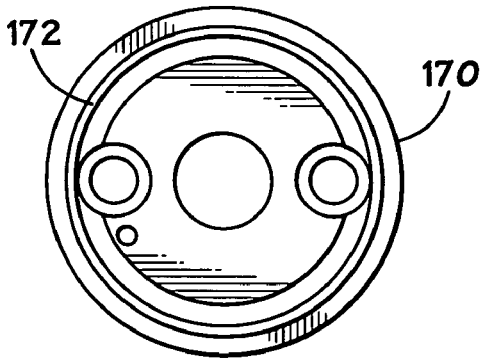
FIG. 6D is a top view of the breech of FIG. 6A.

FIG. 5A shows a blowout preventer 100 according to the present invention which has a main body 102 with an upper flange 104, a lower flange 106, and a central bore 108 therethrough from top to bottom. Assemblies 110 on either side of the main body 102 enclose ram shaft actuators and breeches for accessing rams 112 of the blowout preventer 100 (one shown in FIG. 5B).

Each assembly 110 includes a breech 120 secured to the main body 102 with bolts 114 (or alternatively ((or in addition to)), as desired below, mounted on support rods extending through the main body). The breech 120 has openings 120*a* and 120*b*. A sleeve 130 is movably mounted around the breech 120 and the sleeve 130 is selectively movable to close off and to permit access to a chamber 122 within the breech 120 into which the ram 112 is movable. The ram 112 moves through a main body opening 102*a* through the breech opening 120*b* into the chamber 122. The ram 112 is accessible through an opening 126 which is large enough to remove a ram block 112*a* of the ram 112. Seals 124 seal breech/sleeve interfaces.

A housing 140 is secured with bolts 144 to the breech 120. The housing 140 has opposed spaced-apart end plates 146, 148 each with an opening 146*a*, 148*a* respectively through which pass and in which are movable portions of a shaft 152 of a ram actuator 160. The shaft 152 is connected to the ram 112 and moves in the breech opening 120*a*. A seal 154 seals a shaft-152/breech interface.

A piston 156 on the shaft 152 is movable by system hydraulic fluid under pressure within the housing 140.

To access the ram 112 within the chamber 122, the sleeve 130 is moved away from the breech 120.

A typical side outlet 158 provides access to the interior of the blowout preventer 100 and to a wellbore over which the blowout preventer 100 is positioned.

FIGS. 6A-6D show one particular embodiment of a breech 170 according to the present invention. The breech 170 has a body 172 with ends 171, 173; an interior chamber 174; an opening 176 through which a ram can pass; and an opening 178 for accessing a ram within the chamber 174 and for removing a ram block from the chamber 174. An opening 179 permits sliding passage of an actuator shaft.

Figure 7A:
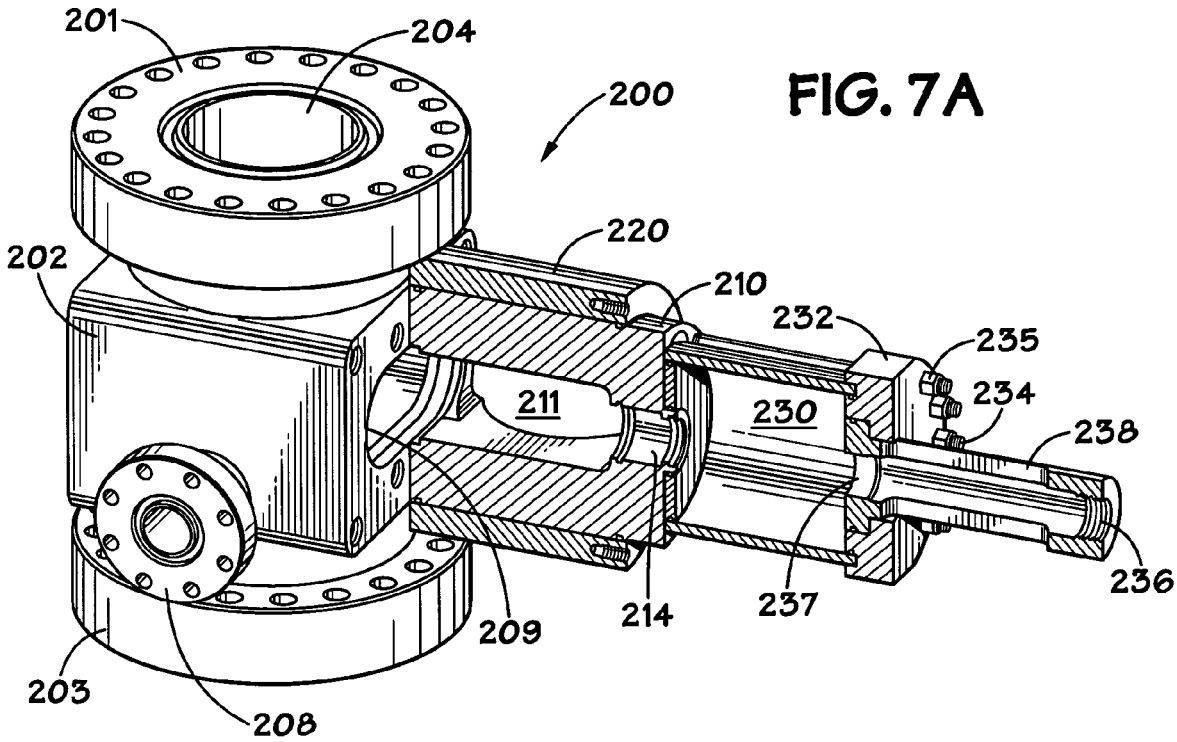
FIG. 7A is a perspective view of a blowout preventer according to the present invention.
Figure 7B:
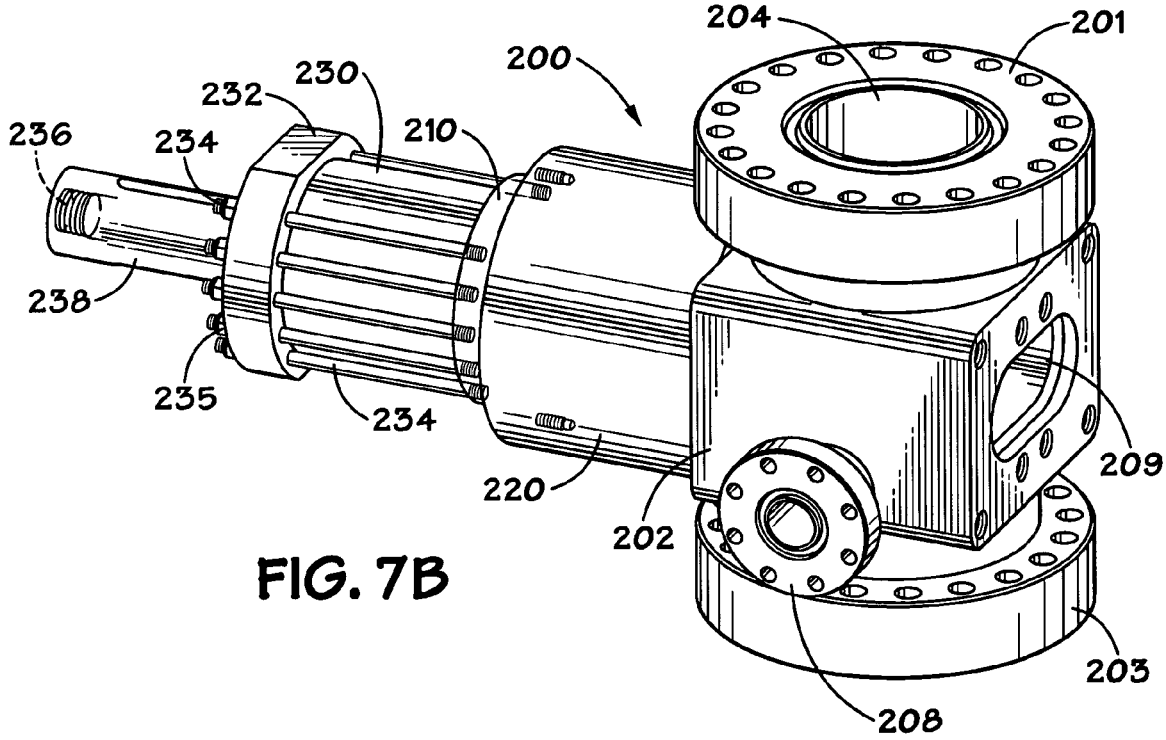
FIG. 7B is a perspective view of a blowout preventer according to the present invention.

FIGS. 7A and 7B show a blowout preventer 200 according to the present invention which has a main body 202 with a top flange 201, a bottom flange 203, a channel 204 therethrough from top to bottom, and a side outlet 208 (like the side outlet 158, FIG. 5A). Rams (not shown; like those described herein for blowout preventers) move in openings 209 (one shown) of the main body 202.

A breech 210 (like the breeches described above; e.g. breeches in FIGS. 1A, 4A, 5A or 6A) is secured to the main body 202 and surrounded by a movable sleeve 220 (like the movable sleeves described above; e.g. sleeves in FIGS. 1A, 4A, 5A, 6A). The sleeve 220 is movable for accessing ram apparatus within the chamber 211 in the breech 210.

An actuator housing 230 has an end plate 232 through which pass bolts 234 which secure the end plate 232 and the housing to the breech 210. Nuts 235 are tightened around threaded ends of the bolts 234. An actuator shaft (not shown) is accessible through an opening 236 in a housing extension 238. The end plate 232 is located so that the sleeve 220 moves over it so that the end plate 232 supports the sleeve 220.

The breech 210 has a chamber 211 from which ram apparatus is movable into the main body 202 and into which ram apparatus is movable through the opening 209 from within the main body 202. An actuator shaft (not shown) moves in and through an opening 214 (like the opening 179) of the breech 210 and in an opening 237 of the end plate 232.

Figure 8:
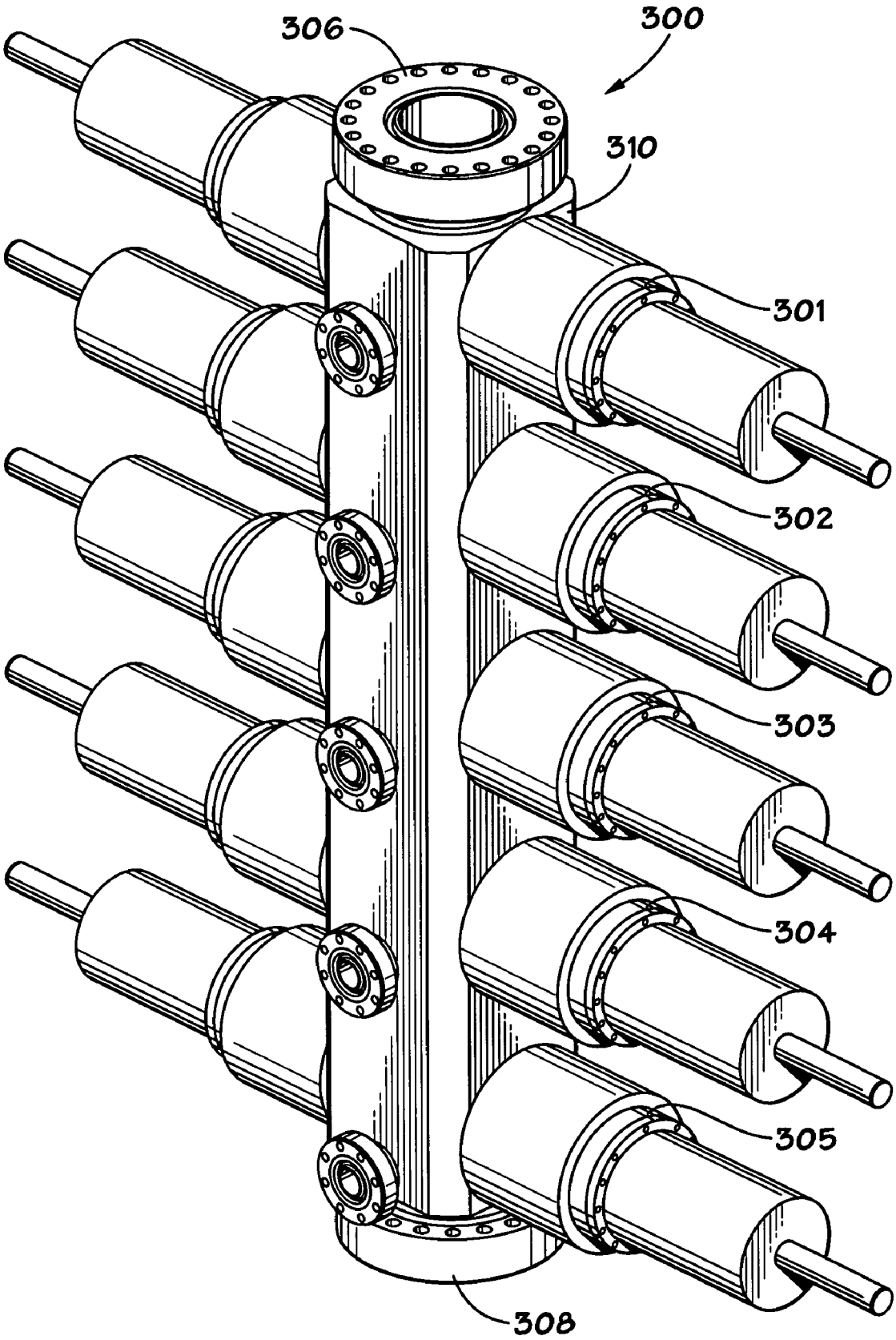
FIG. 8 is a perspective view of a blowout preventer according to the present invention.

FIG. 8 shows a blowout preventer system 300 which has a single integral main body 310 with a top flange 306 and a bottom flange 308 the system 300 includes five apparatuses 301, 302, 303, 304, and 305 which are like any blowout-preventer-with breech apparatus disclosed herein according to the present invention, including, but not limited to, those shown on FIGS. 1A-7B. By eliminating typical doors on the system 300, the main body 310 can be made relatively smaller. By isolating the main body 310 from loads as described above, the main body 310 can be made relatively smaller. By making the main body and/or other parts as described above out of composite material, the main body can be made relatively smaller. By making it possible to store a fully open ram in a breech instead of in a body and/or in a door, the main body can be made relatively smaller.

A system according to the present invention may have one, two, three, four, five, six, or more blowout-preventer-with-breech-containing ram apparatuses (each with opposed pairs of rams and corresponding breeches). In any such apparatus (e.g. those of FIGS. 1A-7B) with the rams fully open the rams can be stored within the breeches.

The present invention, therefore, provides in some, but not in necessarily all embodiments a blowout preventer including: a main body with a main top, a main bottom, and a main bore therethrough from the main top to the main bottom; a breech assembly secured to the main body; ram apparatus movable within the breech assembly and the main body; the breech assembly having a chamber for enclosing part of the ram apparatus, the chamber having a side opening; a sleeve around the breech; the sleeve movable with respect to the breech assembly to uncover the side opening to permit access to part of the ram apparatus within the chamber of the breech. Such a blowout preventer may have one or some, in any possible combination, of the following: wherein the ram apparatus includes a ram block and the ram block is removable from the blowout preventer through the side opening; actuator apparatus for moving the ram apparatus from the breech assembly into the main body and from the main body into the breech assembly, the actuator apparatus including a housing connected to the breech assembly; the actuator housing connected to support apparatus, the support apparatus including support members extending through the main body; wherein the breech assembly and the sleeve are made of composite material; wherein the housing is made of composite material; wherein the ram apparatus includes a ram block and the ram block is entirely storable within the chamber of the breech assembly with the ram apparatus fully open; and/or the sleeve having a hollow round body with a first end having a first diameter and a second end spaced-apart from the first end, the second end having a second diameter, the first diameter substantially equal to the second diameter so that wellbore pressure acting on the sleeve does not move the sleeve.

The present invention, therefore, provides in some, but not in necessarily all embodiments a blowout preventer with: a main body with a main top, a main bottom, and a main bore therethrough from the main top to the main bottom; two breech assemblies secured to the main body, including a first breech assembly on a first side of the main body and a second breech assembly on a second side of the main body, the second side opposed to the first side; first ram apparatus movable within the first breech assembly and the main body; second ram apparatus movable within the second breech assembly and the main body; each breech assembly having a chamber for enclosing part of a corresponding ram apparatus, the chamber having a side opening; a sleeve around each breech; each sleeve movable with respect to its corresponding breech assembly to uncover the side opening to permit access to the ram apparatus within the chamber of the breech. Such a blowout preventer may have support apparatus extending through the main body for supporting the ram apparatuses, the breech assemblies and the sleeves, and the support apparatus isolating the main body from loads imposed on the ram apparatuses.

The present invention, therefore, provides in some, but not in necessarily all embodiments a blowout preventer having: a main body with a main top, a main bottom, and a main bore therethrough from the main top to the main bottom; at least one breech assembly secured to the main body; ram apparatus movable within the breech assembly and the main body; the breech assembly having a chamber for enclosing part of the ram apparatus, the chamber having a side opening; a sleeve around the breech; and the sleeve movable with respect to the breech assembly to uncover the side opening to permit access to ram apparatus within the chamber of the breech. Such a blowout preventer may have a plurality of pairs of opposed breech assemblies, each breech assembly with a corresponding ram apparatus, each ram apparatus including a ram block; and, in one aspect the plurality of pairs of opposed breech assemblies is at least four of said pairs one above the other.

The present invention, therefore, provides in some, but not in necessarily all embodiments a blowout preventer having: a main body with a top, a bottom, and a main bore therethrough from top to bottom; dual opposed bores therethrough extending from an exterior side of the main body to the main bore; dual opposed ram apparatuses each with a ram block, each in one of the dual opposed ram apparatus bores; dual opposed breech apparatuses for selectively enclosing each of the dual opposed ram blocks, each of the ram apparatuses movable from one of the dual opposed breech apparatuses into the main body of the blowout preventer; support apparatus for supporting the dual opposed housing apparatuses, the support apparatus including a plurality of spaced-apart support members extending through, but not secured to, the main body, each of the dual opposed breech apparatuses secured to the plurality of spaced-apart support members.

The present invention, therefore, provides in some, but not in necessarily all embodiments a breech assembly for a blowout preventer, the blowout preventer having a main body for selectively containing ram apparatus, and a ram apparatus opening into which ram apparatus is passable to enter the main body, the breech assembly having: a breech body securable to the main body, a chamber within the breech body, ram apparatus selectively positionable within the chamber, a chamber opening through which the ram apparatus is passable to enter the ram apparatus opening of the main body of the blowout preventer, and a side opening through a side of the breech body, the ram apparatus accessible within the chamber through the side opening. Such a blowout preventer may have one or some, in any possible combination, of the following: a sleeve movably mounted around the breech assembly, the sleeve movable to close off the side opening, and the sleeve movable to uncover the side opening for access to ram apparatus within the chamber; wherein the side opening is sized for removal of the ram apparatus from the chamber; wherein the breech body is made of composite material; wherein the sleeve is made of composite material; actuator apparatus adjacent the breech body for selectively moving the ram apparatus; and/or wherein the actuator apparatus includes a housing, the housing made of composite material.

The present invention, therefore, provides in some, but not in necessarily all embodiments a method for accessing ram apparatus of a blowout preventer, the blowout preventer as any disclosed herein according to the present invention the method including moving a sleeve to uncover a side opening to access part of the ram apparatus.

The present invention, therefore, provides in some, but not in necessarily all embodiments a method for reducing loading on a main body of a blowout preventer, the blowout preventer having a main body with a top, a bottom, and a main bore therethrough from top to bottom, dual opposed bores therethrough extending from an exterior side of the main body to the main bore, dual opposed ram apparatuses, each in one of the dual opposed ram apparatus bores, dual opposed breech apparatuses for selectively enclosing part of each of the dual opposed ram apparatuses, each of the ram apparatuses movable from one of the dual opposed breech apparatuses into the main body of the blowout preventer through one of the dual opposed ram bores, and support apparatus for supporting the dual opposed ram apparatuses and the breech apparatuses, the support apparatus including a plurality of spaced-apart support members extending through, but not secured to, the main body, each of the dual opposed housing apparatuses secured to the plurality of spaced-apart support members; the method including supporting the dual opposed breech apparatuses and the dual opposed ram apparatuses with the support apparatus, and with the support apparatus isolating the main body from loads on the dual opposed ram apparatuses.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. A blowout preventer comprising a main body with a main top, a main bottom, and a main bore therethrough from the main top to the main bottom, a breech assembly secured to the main body, the breech assembly having a generally cylindrical breech body, ram apparatus movable within the breech assembly and the main body, the breech assembly having a chamber for enclosing part of the ram apparatus, the chamber having a side opening, a sleeve around the breech assembly, the sleeve having a generally cylindrical sleeve body, and the sleeve movable with respect to the breech assembly to a position spaced-apart from the main body to uncover the side opening to permit access to part of the ram apparatus within the chamber of the breech assembly.

2. The blowout preventer of claim 1 wherein the ram apparatus includes a ram block and the ram block is removable from the blowout preventer through the side opening.

3. The blowout preventer of claim 1 further comprising actuator apparatus for moving the ram apparatus from the breech assembly into the main body and from the main body into the breech assembly, the actuator apparatus including a housing connected to the breech assembly, said housing being generally cylindrical.

4. The blowout preventer of claim 1 further comprising the actuator housing connected to support apparatus, the support apparatus including support members extending through the main body.

5. The blowout preventer of claim 1 wherein the breech assembly and the sleeve are made of composite material.

6. The blowout preventer of claim 3 wherein the housing is made of composite material.

7. The blowout preventer of claim 1 wherein the ram apparatus includes a ram block and the ram block is entirely storable within the chamber of the breech assembly with the ram apparatus fully open.

8. A blowout preventer comprising a main body with a main top, a main bottom, and a main bore therethrough from the main top to the main bottom, two breech assemblies secured to the main body, including a first breech assembly on a first side of the main body and a second breech assembly on a second side of the main body, the second side opposed to the first side, each breech assembly having a generally cylindrical breech body, first ram apparatus movable within the first breech assembly and the main body, second ram apparatus movable within the second breech assembly and the main body, each breech assembly having a chamber for enclosing part of a corresponding ram apparatus, the chamber having a side opening, a sleeve around each breech assembly, each sleeve being generally cylindrical, each sleeve movable with respect to its corresponding breech assembly to a position spaced-apart from the main body to uncover the side opening to permit access to the ram apparatus within the chamber of the breech assembly.

9. The blowout preventer of claim 8 further comprising support apparatus extending through the main body for supporting the ram apparatuses, the breech assemblies and the sleeves, and the support apparatus isolating the main body from loads imposed on the ram apparatuses.

10. A blowout preventer comprising a main body with a main top, a main bottom, and a main bore therethrough from the main top to the main bottom, at least one breech assembly secured to the main body, the at least one breech assembly having a generally cylindrical breech body, ram apparatus movable within the breech assembly and the main body, the breech assembly having a chamber for enclosing part of the ram apparatus, the chamber having a side opening, a sleeve around the breech assembly, the sleeve being generally cylindrical, and the sleeve movable with respect to the breech assembly to a position spaced-apart from the main body to uncover the side opening to permit access to ram apparatus within the chamber of the breech assembly.

11. The blowout preventer of claim 10 wherein the at least one breech assembly is a plurality of pairs of opposed breech assemblies, each breech assembly with a corresponding ram apparatus, each ram apparatus including a ram block.

12. The blowout preventer of claim 11 wherein the plurality of pairs of opposed breech assemblies is at least four of said pairs, one above the other.

13. A breech assembly for a blowout preventer, the blowout preventer having a main body for selectively containing ram apparatus, and a ram apparatus opening into which ram apparatus is passable to enter the main body, the breech assembly comprising a breech body securable to a main body of a blowout preventer, the breech body being generally cylindrical, a chamber within the breech body, ram apparatus selectively positionable within the chamber, a chamber opening through which the ram apparatus is passable to enter the ram apparatus opening of the main body of the blowout preventer, a side opening through a side of the breech body, the ram apparatus accessible within the chamber through the side opening, and the breech assembly securable to the main body.

14. The breech assembly of claim 13 further comprising a sleeve movably mounted around the breech assembly, the sleeve being generally cylindrical, the sleeve movable to close off the side opening, and the sleeve movable to uncover the side opening for access to ram apparatus within the chamber.

15. The breech assembly of claim 14 wherein the side opening is sized for removal of the ram apparatus from the chamber.

16. The breech assembly of claim 13 wherein the breech body is made of composite material.

17. The breech assembly of claim 14 wherein the sleeve is made of composite material.

18. The breech assembly of claim 13 further comprising actuator apparatus adjacent the breech body for selectively moving the ram apparatus.

19. The breech assembly of claim 18 wherein the actuator apparatus includes a generally cylindrical housing, the generally cylindrical housing made of composite material.

20. A method for accessing ram apparatus of a blowout preventer, the blowout preventer comprising a main body with a main top, a main bottom, and a main bore therethrough from the main top to the main bottom, a breech assembly secured to the main body, the breech assembly having a generally cylindrical breech body, ram apparatus movable within the breech assembly and the main body, the breech assembly having a chamber for selectively enclosing part of the ram apparatus, the chamber having a side opening, a sleeve around the breech assembly, the sleeve being generally cylindrical and the sleeve movable with respect to the breech assembly to uncover the side opening to permit access to part of the ram apparatus within the chamber of the breech assembly, the method including moving the sleeve to a position spaced-apart from the main body to uncover the side opening to permit access to part of the ram apparatus.

* * * * *